US006530379B2

(12) United States Patent
Iosilevich

(10) Patent No.: US 6,530,379 B2
(45) Date of Patent: Mar. 11, 2003

(54) METHOD OF DEPOSITING COSMETIC PIGMENT MATERIAL ONTO SURFACES OF APPLICATOR PADS IN A PATTERN, AND PIGMENT DEPOSITING APPARATUS

(76) Inventor: Irina Iosilevich, 21005 Madria Cir., Boca Raton, FL (US) 33433

( * ) Notice: Subject to any disclaimer, the term of this patent is extended or adjusted under 35 U.S.C. 154(b) by 0 days.

(21) Appl. No.: 09/852,062

(22) Filed: May 8, 2001

(65) Prior Publication Data

US 2002/0020422 A1 Feb. 21, 2002

Related U.S. Application Data

(60) Provisional application No. 60/207,275, filed on May 30, 2000.

(30) Foreign Application Priority Data

May 9, 2000 (GB) ..... 0011186

(51) Int. Cl.[7] ..... A45D 40/30; A45D 24/00

(52) U.S. Cl. ..... 132/319; 132/200

(58) Field of Search ..... 132/319, 317, 132/320, 216, 218, 200; 206/823, 571, 581, 229

(56) References Cited

U.S. PATENT DOCUMENTS 4,936,325 A * 6/1990 Davis ..... 132/319
5,137,040 A 8/1992 Iosilevich et al. ..... 132/320
5,690,130 A * 11/1997 Gunderman et al. ..... 132/319
5,928,797 A * 7/1999 Vineberg ..... 428/500
6,119,704 A * 9/2000 Bouchat et al. ..... 132/320

* cited by examiner

*Primary Examiner*—John J. Wilson
*Assistant Examiner*—Robyn Kieu Doan
(74) *Attorney, Agent, or Firm*—Frank L. Kubler

(57) ABSTRACT

A method of applying cosmetic pigment powder onto an applicator structure sheet in a desired pigment pattern includes the steps of providing an applicator structure sheet formed of at least one and preferably several laterally interconnected applicator structures; providing a silk screen apparatus having a piece of stencil silk or equivalent stencil sheet material known a bolting cloth stretched across a wooden frame; dissolving conventional cosmetic pigment powder in a suspension liquid; creating a stencil including a desired pattern for one applicator structure and preferably an array of patterns for several applicator structures; placing the stencil onto the silk screen, which acts as a support; using a squeegee or equivalent device to force the pigment liquid through the open areas in the stencil and through the silk screen onto the applicator structure sheet and thereby printing the one or arrayed several patterns onto the applicator structure sheet; and removing the applicator structure sheet from the apparatus. A second method includes steps of printing a desired pigment material in a desired pattern onto the sheet with an electrostatic printing apparatus.

14 Claims, 1 Drawing Sheet

METHOD OF DEPOSITING COSMETIC PIGMENT MATERIAL ONTO SURFACES OF APPLICATOR PADS IN A PATTERN, AND PIGMENT DEPOSITING APPARATUS

This application claims the benefit of provisional application 60/207,275 filed May 30, 2000.

BACKGROUND OF THE INVENTION

1. Field of the Invention

The present invention relates generally to the field of make-up and its application. More specifically the present invention relates to inter-related methods of applying pigment material in the form of eye shadow, blush pigment powder or face powder, or eyelash or other cosmetic pigment material to the surface of an applicator structure such as an applicator pad in discrete locations, and optionally in multiple colors, to form any one of numerous patterns for transfer to the skin or eyelashes of a user. The first method includes steps of printing a desired pigment material pattern onto a sheet formed of at least one and preferably a plurality of laterally interconnected applicator structures with a silk screen apparatus. The second method includes the steps of printing a desired pigment material in a desired pattern onto the sheet with an electrostatic printing apparatus.

2. Description of the Prior Art

There have long been methods for providing and delivering cosmetic pigment powder onto user skin. In most instances, pigment powder is pressed into a flat cake and placed in a recess within a bottom panel of a hinged case, so that quantities of the pigment powder can be gather on a brush or pad by sliding the brush or pad over the surface of the cake and then deposited onto the user skin by sliding the brush or pad over the skin. Alternatively the pigment powder or powder cake is simply loose in a box, and once again is extracted with a brush or pad. A problem with these prior powder configurations and methods of application have been that it is difficult or impossible to deliver a precise pigment pattern onto the user skin. Another problem has been that the case or box and application brushes are bulky to carry and are not disposable with each use, so that the user is almost never free of them.

The present applicant developed a disposable applicator pad having a desired pigment material pattern on its surface, which is disclosed in U.S. Pat. No. 5,137,040, issued on Aug. 11, 1992. While the disclosed applicator pad solves many of the problems identified, no suitable method of production is revealed in this reference. What is needed is a method of rapidly and economically producing a disposable applicator structure such as a pad having a precisely defined desired pigment pattern on its surface for direct application and transfer onto a user skin.

It is thus an object of the present invention to provide a method of depositing cosmetic pigment material onto an applicator structure such as a pad in a specific arrangement defining a desired pattern of one or more colors, so that at least some of the deposited pigment material is free to transfer onto the skin of a user upon pressing the deposited pigment material on the pad against the skin of the user, thereby recreating with precision a mirror image of the pattern on the user skin.

It is another object of the present invention to provide such a method of depositing which is rapid, hygienic, can print pigment patterns on numerous pads simultaneously and, since the pigment is printed directly on the pad itself, does not require separate pigment material powder cakes or brushes and thus saves space.

It is still another object of the present invention to provide which creates a pad which is economically suitable for one-time pad use and is readily disposable.

It is finally an object of the present invention to provide such a method which is highly economical to practice.

SUMMARY OF THE INVENTION

The present invention accomplishes the above-stated objectives, as well as others, as may be determined by a fair reading and interpretation of the entire specification.

A method is provided of applying cosmetic pigment powder onto an applicator structure sheet in a desired pigment pattern, including the steps of providing an applicator structure sheet formed of at least one and preferably several laterally interconnected applicator structures; providing a silk screen apparatus having a piece of stencil silk or equivalent stencil sheet material known as bolting cloth stretched across a wooden frame; dissolving cosmetic pigment powder in a suspension liquid; creating a stencil including a desired pattern for one applicator structure; placing the stencil onto the stencil sheet material, which acts as a support; using a squeegee or equivalent device to force the pigment liquid through the open areas in the stencil and through the silk screen onto the applicator structure sheet and thereby printing the at least one, or arrayed several patterns, onto the applicator structure sheet; and removing the applicator structure sheet from the apparatus.

Where the sheet includes several applicator structures, comprising the additional step of separating said several applicator structures from each other. The step of creating the stencil preferably includes the steps of producing a photographic image of the desired pigment pattern.

The step of creating the stencil optionally includes the steps of mixing the pigment powder with one of shellac and glue to form a pigment fluid; and painting the pigment fluid onto the stencil sheet material. The step of creating the stencil alternatively includes the steps of mixing the pigment powder with one of peccim and water to form a pigment liquid; and painting the pigment fluid onto the stencil sheet material. The applicator structure sheet preferably includes one of: pelen and sponge material.

A method of applying cosmetic pigment powder onto an applicator structure sheet in a desired pigment pattern, including the steps of providing an applicator structure sheet formed of at least one applicator structure; providing a pigment depositing apparatus having a photoconductive insulating layer on a conductive support charged plate, where the layer is charged electrostatically with ions, the polarity of the charge depending on the type of photoconductive insulating layer selected, and having a pigment receiving sheet entry structure; placing an electrical charge on a quantity of pigment powder; placing the quantity of pigment powder into the pigment depositing apparatus; placing a sheet including at least one applicator structure into the pigment receiving sheet entry structure; placing a guidance image of a pattern in the apparatus; activating the apparatus printing elements to draw the sheet through its printing mechanism and printing the pigment powder onto the sheet in a configuration corresponding to the guidance image; so that the charged pigment powder is transferred to the applicator structure sheet in concentrations corresponding to the charge concentrations on the applicator structure sheet and the image is printed onto the applicator structure sheet; and removing the applicator structure sheet.

Where the applicator structure sheet includes several applicator structures, and the method includes the additional step of separating the applicator structures from each other. The apparatus preferably additionally includes a transparent scan support glass sheet, where the guidance image of the desired pattern is placed into the apparatus by placing an image sheet marked with the desired pattern onto the scan support glass sheet. Where the apparatus additionally includes a computer monitor having a computer screen, and where the guidance image of the desired pattern is placed into the apparatus by generating the guidance image on the computer screen, the method includes the step of generating the guidance image on the computer screen using graphics software.

The step of the apparatus printing the pigment powder onto the applicator software sheet includes the steps of sprinkling the pigment powder over the charge plate so that areas of the layer subjected to light lose a varying portion of their charge depending upon the intensity of the illumination and so that the powder adheres to those areas of the layer that have retained their charge; placing the charge plate on the applicator structure sheet; and applying a charge of the same polarity as the initial charge applied to the photoconductive insulating layer over the back of the applicator structure sheet. The method preferably includes the additional step of providing a sheet formed of several laterally interconnected applicator structures.

The step of placing the quantity of pigment powder into the apparatus preferably includes the steps of mixing the pigment powder with a liquid to form a pigment liquid; and delivering the pigment liquid into a pigment receptacle; and placing the pigment receptacle into the apparatus. The step of placing the quantity of pigment powder into the apparatus preferably includes the steps of placing the pigment powder into a pigment powder cartridge; and placing the pigment powder cartridge into the apparatus.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
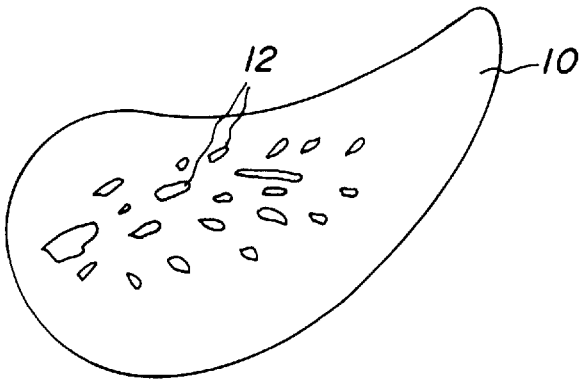
FIG. 1 is a plan view of one of the application pads for a square face with a pattern of cosmetic pigment material on its surface.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Methods

Figure 2:
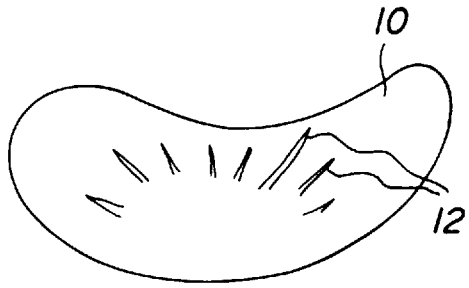
FIG. 2 is a plan view of one of the application pads for a round face with a pattern of cosmetic pigment material on its surface.
Figure 3:
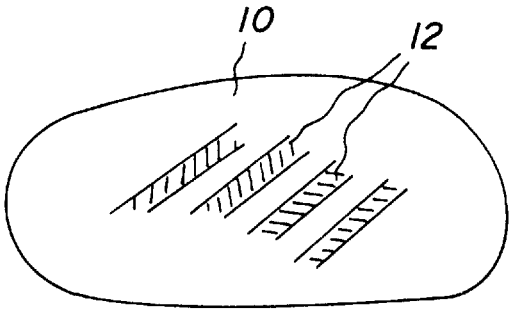
FIG. 3 is a plan view of one of the application pads for a heart-shaped face with a pattern of cosmetic pigment material on its surface.
Figure 4:
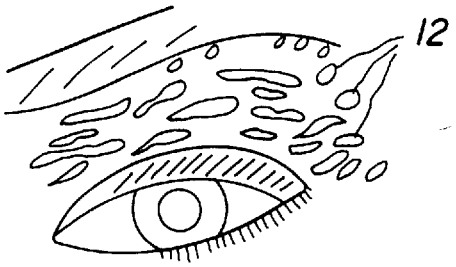
FIG. 4 is a front view of a user eye with a particular pigment material pattern transferred from an application pad onto the user skin above the eyelid.
Figure 5:
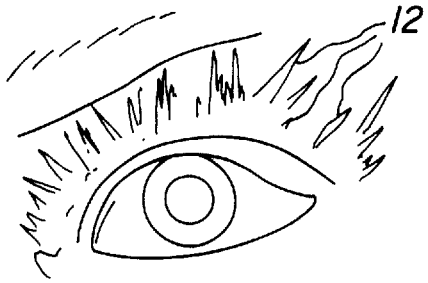
FIG. 5 is a front view of a user eye with another exemplary pigment material pattern transferred onto the user skin above the eyelid.

Referring to FIGS. 1–5, methods of applying pigment material 12 in the form of eye shadow or blush pigment powder, or eyelash or other cosmetic pigment material 12 to the surface of an applicator structure 10 such as an applicator pad in discrete locations, and optionally in multiple colors, to form any one of numerous patterns for transfer to the skin or eyelashes of a user are disclosed.

The first method includes the steps of providing an applicator structure 10 sheet formed of at least one and preferably a plurality of laterally interconnected applicator structures 10; providing a silk screen apparatus having a piece of stencil silk or equivalent stencil sheet material known as bolting cloth stretched across a wooden frame; dissolving conventional cosmetic pigment powder 12 in a suspension liquid; creating a stencil including a desired pattern for one applicator structure 10 and preferably an array of patterns for a plurality of applicator structures 10; placing the stencil onto the silk screen, which acts as a support; using a squeegee or equivalent device to force the pigment liquid through the open areas in the stencil and through the silk screen onto the applicator structure 10 sheet and thereby printing the one or arrayed plurality of patterns onto the applicator structure 10 sheet; removing the applicator structure 10 sheet from the apparatus and, where the sheet comprises several applicator structures 10, separating the applicator structures 10 from each other. The stencil is preferably created by a well-known photographic process used in silk screening or by painting the pigment directly onto the silk sheet with shellac or glue or by cutting the pattern into stencil sheets known as pro-film. The suspension liquid is preferably water or peccim, an ingredient of gelatin. The pigment applicator structure 10 is preferably a pad formed of pelen, which is a material commonly used inside shirt collars and cuffs, but alternatively may be formed of sponge material.

The second method includes the steps of providing a pigment depositing apparatus having a photoconductive insulating layer on a metal or other conductive support, where the layer is charged electrostatically, either with positive or negative ions, the polarity of the charge depending on the type of photoconductive insulating layer selected; placing an electrical charge on a quantity of pigment powder 12; placing the quantity of charged pigment powder 12 into a pigment powder cartridge; placing the pigment powder cartridge into a pigment depositing apparatus having the essential elements of a computer printer or photocopy machine with a pigment receiving sheet entry structure and with the heat setting element of the not provided, disabled or removed; placing a sheet comprising at least one applicator structure 10 and preferably an interconnected sheet of contiguous applicator structures 10 into the pigment receiving sheet entry structure; placing a guidance image of the desired pattern into the apparatus; activating the apparatus printing elements to draw the sheet through its printing means and printing the pigment powder 12 onto the sheet in a configuration corresponding to the guidance image. As a result, the charged pigment powder 12 is transferred to the sheet surface in concentrations corresponding to the charge concentrations on the sheet, such that the image, which may be a repeating pattern so that a full individual pattern, is printed onto each applicator structure 10 in the sheet; removing the sheet of the at least one applicator structure 10 and, where the sheet comprises several applicator structures 10, separating the applicator structures 10 from each other.

The guidance image of the desired pattern preferably is placed into the apparatus by placing image sheet onto an apparatus scan support glass or generated on the computer screen with any suitable graphics software. The apparatus preferably prints pigment powder 12 onto the applicator structure 10 sheet by sprinkling the pigment powder 12 over the charge plate the charged pigment powder 12 such that the areas of the layer subjected to light lose a varying portion of the charge, depending upon the intensity of the illumination, and such that the powder 12 adheres to those areas of the layer that have retained their charge, the charge plate is covered with the sheet and a charge is then applied over the back of the sheet of the same polarity as the initial charge applied to the photoconductive insulating layer. For a laser jet computer printer, the eye shadow pigment material 12 preferably is provided in powder form and mixed into a water- or oil-based liquid for insertion into the ink receptacle.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of applying cosmetic pigment powder onto an applicator structure sheet in a desired pigment pattern, comprising the steps of:

providing an applicator structure sheet formed of at least one and preferably a plurality of laterally interconnected applicator structures;

providing a silk screen apparatus having a piece of stencil sheet material stretched across a wooden frame;

dissolving cosmetic pigment powder in a suspension liquid;

creating a stencil including a desired pattern for one applicator structure;

placing the stencil onto the stencil sheet material, which acts as a support;

using a squeegee or equivalent device to force the pigment liquid through the open areas in the stencil and through the stencil sheet material screen onto the applicator structure sheet and thereby printing at least one pattern onto the applicator structure sheet;

and removing the applicator structure sheet from the apparatus.

2. The method of claim 1, wherein said sheet comprises a plurality of applicator structures, comprising the additional step of:

separating said plurality of applicator structures from each other.

3. The method of claim 1, wherein said step of creating the stencil comprises the step of:

producing a photographic image of the desired pigment pattern.

4. The method of claim 1, wherein said step of creating the stencil comprises the steps of:

mixing said pigment powder with one of shellac and glue to form a pigment fluid;

and painting said pigment fluid onto the stencil sheet material.

5. The method of claim 1, wherein said step of creating the stencil comprises the steps of:

mixing said pigment powder with one of peccim and water to form a pigment liquid;

and painting said pigment fluid onto the stencil sheet material.

6. The method of claim 1, wherein said applicator structure sheet comprises one of pelen and sponge material.

7. A method of applying cosmetic pigment powder onto an applicator structure sheet in a desired pigment pattern, comprising the steps of:

providing an applicator structure sheet formed of at least one applicator structure;

providing a pigment depositing apparatus having a photoconductive insulating layer on a conductive support charged plate, where the layer is charged electrostatically with ions, and having a pigment receiving sheet entry structure;

placing an electrical charge on a quantity of pigment powder;

placing the quantity of pigment powder into said pigment depositing apparatus;

placing a sheet comprising at least one applicator structure into the pigment receiving sheet entry structure;

placing a guidance image of a pattern in the apparatus;

activating the apparatus printing elements to draw the sheet through its printing means and printing the pigment powder onto the sheet in a configuration corresponding to the guidance image;

such that the charged pigment powder is transferred to said applicator structure sheet in concentrations corresponding to the charge concentrations on said applicator structure sheet and the image is printed onto said applicator structure sheet;

and removing said applicator structure sheet.

8. The method of claim 7, wherein said applicator structure sheet comprises a plurality of applicator structures, comprising the additional step of separating said applicator structures from each other.

9. The method of claim 7, wherein said apparatus additionally comprises a transparent scan support glass sheet, wherein said guidance image of the desired pattern is placed into said apparatus by placing an image sheet marked with the desired pattern onto said scan support glass sheet.

10. The method of claim 7, wherein said apparatus additionally comprises a computer monitor having a computer screen, wherein said guidance image of the desired pattern is placed into said apparatus by generating the guidance image on said computer screen, comprising the step of:

generating said guidance image on the computer screen using graphics software.

11. The method of claim 7, wherein the step of said apparatus printing said pigment powder onto said applicator software sheet comprises the steps of:

sprinkling said pigment powder over said charge plate such that areas of said layer subjected to light lose a varying portion of their charge depending upon the intensity of the illumination and such that the powder adheres to those areas of the layer that have retained their charge;

placing said charge plate on said applicator structure sheet;

and applying a charge of the same polarity as the initial charge applied to the photoconductive insulating layer over the back of said applicator structure sheet.

12. The method of claim 7, comprising the step of providing a sheet formed of a plurality of laterally interconnected applicator structures.

13. The method of claim 7, wherein the step of placing the quantity of pigment powder into said apparatus comprises the steps of mixing said pigment powder with a liquid to form a pigment liquid; and delivering said pigment liquid into a pigment receptacle; and placing said pigment receptacle into said apparatus.

14. The method of claim 1, wherein the step of placing the quantity of pigment powder into said apparatus comprises the steps of placing said pigment powder into a pigment powder cartridge; and placing said pigment powder cartridge into said apparatus.

* * * * *